US006053459A

United States Patent [19]

Priefert et al.

[11] Patent Number: 6,053,459

[45] Date of Patent: Apr. 25, 2000

[54] COLLAPSIBLE GARBAGE BAG STAND

[75] Inventors: Lonnie Priefert, Beatrice, Nebr.; Edward Priefert, Mt. Pleasant; Kelly Donnelly, Pittsburg, both of Tex.

[73] Assignee: Priefert Manufacturing Company, Mount Pleasant, Tex.

[21] Appl. No.: 09/032,580

[22] Filed: Feb. 27, 1998

[51] Int. Cl.[7] ..... A63B 55/04

[52] U.S. Cl. ..... 248/97; 248/175; 248/99; 248/176.2

[58] Field of Search ..... 248/153, 97, 175, 248/176.2, 99, 150, 439, 95

[56] References Cited

U.S. PATENT DOCUMENTS

| | | | |
|---|---|---|---|
| D. 216,438 | 1/1970 | Gay | 248/97 |
| 587,231 | 7/1897 | Parker | 248/175 |
| 711,410 | 10/1902 | Means | 248/97 |
| 903,986 | 11/1908 | Klahn | 248/176.2 |
| 1,278,385 | 9/1918 | Rickard | 248/175 |
| 3,627,242 | 12/1971 | Vandermast | 248/97 |
| 5,058,839 | 10/1991 | Stevens | 248/97 |
| 5,393,023 | 2/1995 | Callan | 248/97 |
| 5,826,837 | 10/1998 | Moineau et al. | 248/97 |

*Primary Examiner*—Leslie A. Braun
*Assistant Examiner*—Kimberly T. Wood
*Attorney, Agent, or Firm*—Kent A. Herink, Esq.; Daniel A. Rosenberg; Davis Brown Law Firm

[57] ABSTRACT

A support stand for a garbage bag. A plurality of support members are attached to a bottom hoop for pivotal movement between a storage position substantially coplanar with the bottom hoop and a substantially vertical working position. An upper hoop is constrained for movement with the support members between a collapsed, storage position and an elevated working position above the lower hoop supported on said support members. The support members and the upper hoop cooperate to retain releasably the upper hoop in its working position. A garbage bag is inserted inside the upper hoop and supported by the garbage bag support stand with its open end facing upwardly. The support stand can be lifted over a filled bag, thus avoiding having to lift a filled bag to reposition the support stand.

5 Claims, 2 Drawing Sheets

COLLAPSIBLE GARBAGE BAG STAND

BACKGROUND OF THE INVENTION

1. Field of the Invention

The invention relates generally to stands for supporting garbage bags and, more specifically, to a collapsible wire stand that supports a garbage bag for easy filling of the supported bag.

2. Background of the Prior Art

It has become very common place for people to use inexpensive disposable bags for collecting and holding a wide variety of waste materials, particularly for later pick-up by the garbage or sanitation department of the local municipality or other political subdivision. The most common type of garbage used in homes and businesses are open-top bags made of polyethylene film. While the polyethylene film bags are strong enough and sufficiently impermeable for most applications, they are not free standing and so frequently must be supported so that they will stand upright and with the top open for the addition of waste materials. In this regard, polyethylene bags are often referred to as can liners because they are frequently supported by garbage or trash cans during use as a waste receptacle. Upon being filled, the top end is closed and the filled liner or bag is removed from the supporting trash can by lifting it above the top perimeter of the trash can.

Another common application of polyethylene bags and more recently garbage or waste bags made from paper, is in holding yard waste, such as grass clippings, leaves, twigs, and similar materials. The bags are either used unsupported, by laying them on their side and inserting waste materials through the side-facing open top or by the use of portable light-weight stands which hold the bags in an upright, open position. For maximum utility and ease of use, garbage bag stands should be strong, light-weight, easily portable, have a compact storage configuration and preferably be removable from the filled bag without requiring the oftentimes heavy filled bag to be lifted above the top of the bag stand.

SUMMARY OF THE INVENTION

The invention consist of a collapsible wire stand for garbage bags. A hoop of a first, smaller diameter is supported above a base hoop of a second, larger diameter by a plurality of vertical supports that interconnect the two hoops. The vertical supports are permanently attached to the lower hoop for pivotal movement between a horizontal, storage position collapsed across the center of the larger hoop and a vertical, working position. The upper hoop is constrained for sliding movement inside each of the vertical supports between a collapsed, storage position substantially coplanar with the larger hoop and an elevated working position supported centrally above the larger hoop on the vertical supports. In the preferred embodiment a plurality of detents are provided to releasably hold the upper hoop in the working position.

An object of the invention is to provide strong, lightweight, easily transportable garbage bag support that can be collapsed to a storage position having a small volume.

Another object of the invention is to provide a garbage bag support which supports a garbage bag during filling of the bag and, after the bag is filled, can be lifted over the filled bag.

These and other objects of the invention will be made apparent to a person skilled in the art upon reading and understanding of the specification, the associated drawings, and appended claims.

DETAILED DESCRIPTION OF A PREFERRED EMBODIMENT

Figure 1:
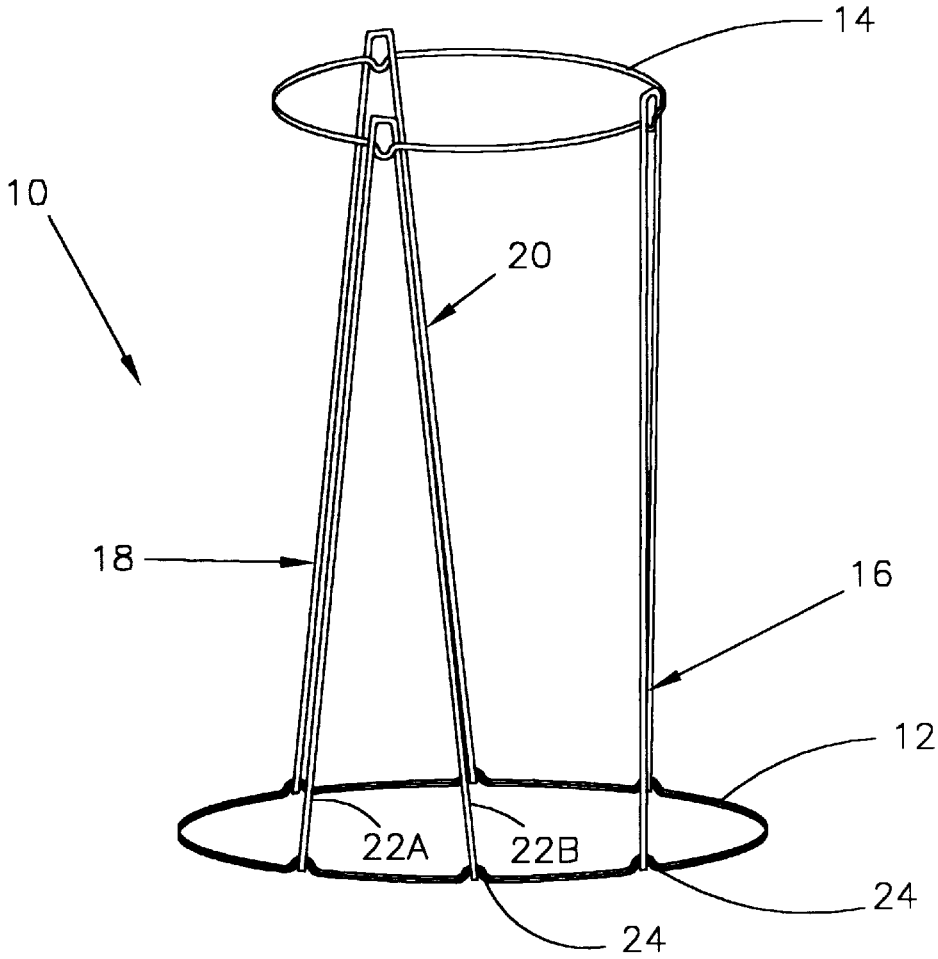
FIG. 1 is a perspective view of the garbage bag support of the present invention in its expanded, working configuration.

Referring to FIG. 1 there is illustrated, generally at 10, a garbage bag support of the present invention. The garbage bag support 10 includes a first, larger diameter hoop 12 and a second, smaller diameter hoop 14. The hoop 12 forms the base of the garbage support 10. The hoop 14 is supported above the base hoop 12 on three vertical supports 16, 18, and 20. Each of the supports 16–20 are substantially V-shaped and are secured for pivotal movement about the large hoop 12 at the bottom terminal end portions of each of their leg members 22*a* and 22*b*. Pivotal attachment of the supports 16–20 to the base hoop 12 is achieved by the formation of six equidistantly spaced upright dimples 24 in the base hoop 12. The bottom terminal end portions of the legs 22*a* and 22*b* are bent into an eye around an adjacent pair of the upright dimples 24 so that each of the supports 16–20 is pivotable relative to the base hoop 12. The upright dimples 24 and eyes of the leg members 22*a* and 22*b* are sized so that the leg members 22*a* and 22*b* are constrained inside the upright dimples 24 and thereby prevented from moving around the circumferential perimeter of the base hoop 12.

Each of the base hoop 12, the upper hoop 14 and the support 16–20 are made of metal to provide rigidity and strength to the structure with also a sufficient degree of flexibility to allow for assembly as will be described in more detail below.

Figure 2:
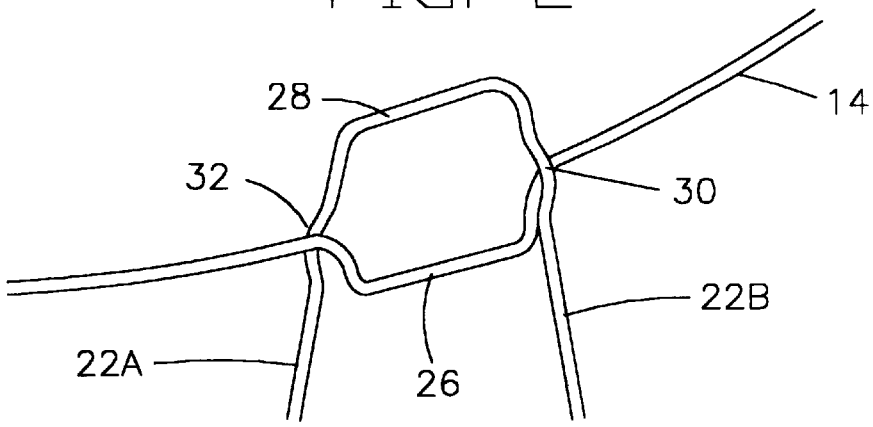
FIG. 2 is an enlarged, detailed view of the intersection between a vertical support and an upper hoop of the storage bag support in the configuration as illustrated in FIG. 1.

The upper hoop 14 passes through the interior of each of the supports 16–20. In this way, the upper hoop 14 is constrained for movement inside the pivotable supports 16–20. The hoop 14 is held in its upper, working position as illustrated in FIG. 1 by a series of cooperating bends in the hoop 14 and each of the support 16–20, as best illustrated in FIG. 2. The upper hoop 14 is formed with three equidistantly spaced downwardly projecting sections, one of which is illustrated in FIG. 2 at 26. Each of the supports 16–20 have an upper or distal end section 28 that is flat. Adjacent the end section 28 a pair of dimples 30 and 32 are formed in the leg members 22*a* and 22*b*, respectively. The dimple 30 projects generally radially inwardly relative to the hoop 14 while the dimple 32 projects generally radially outwardly relative to the hoop 14. As is illustrated in FIG. 2, when the hoop 14 is moved to its upper or working position, corresponding to FIG. 1, the downwardly projecting section 26 is positioned inside the dimples 30 and 32.

It will be appreciated that when each of the three downwardly projecting sections 26 of the hoop 14 are appropriately positioned relative to the three supports 16–20, as illustrated in FIG. 1, the hoop 14 is effectively captured by each of the supports 16–20 and held in a fixed support position referred to as the working position of the upper hoop 14. The retention of the upper hoop in the working position is further assisted by a torsional force that is exerted by the upper hoop 14 on the dimples 30 and 32, the net result of which is to twist the corresponding support relative to its neutral position.

Figure 3:
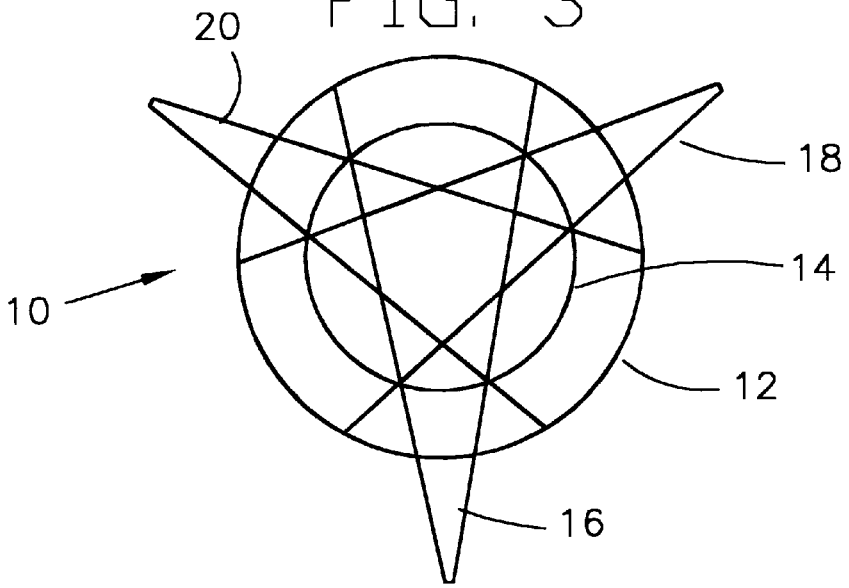
FIG. 3 is a planned view of the garbage bag support in its collapsed, storage configuration.

In operation, the garbage bag support 10 is put into use by positioning the collapsed bag support such that the hoop 12 is on the ground and the hoop 14 is above it (FIG. 3). The hoop 14 is then grasped and lifted, whereupon the supports 16–20 begin to pivot about the hoop 12 toward an upright position. As the hoop 14 is lifted, the supports 16–20 move from a horizontal position wherein they are crossed, overlying each other (FIG. 3), to the upright position (FIG. 1). Given that the hoop 14 is captured inside each of the supports 16–20, it turns over in the transition from the lower, collapsed or storage position to the upper or working position. Once the hoop 14 has been fully raised, it is positioned so that it is appropriately captured in the working position as described above.

Figure 4:
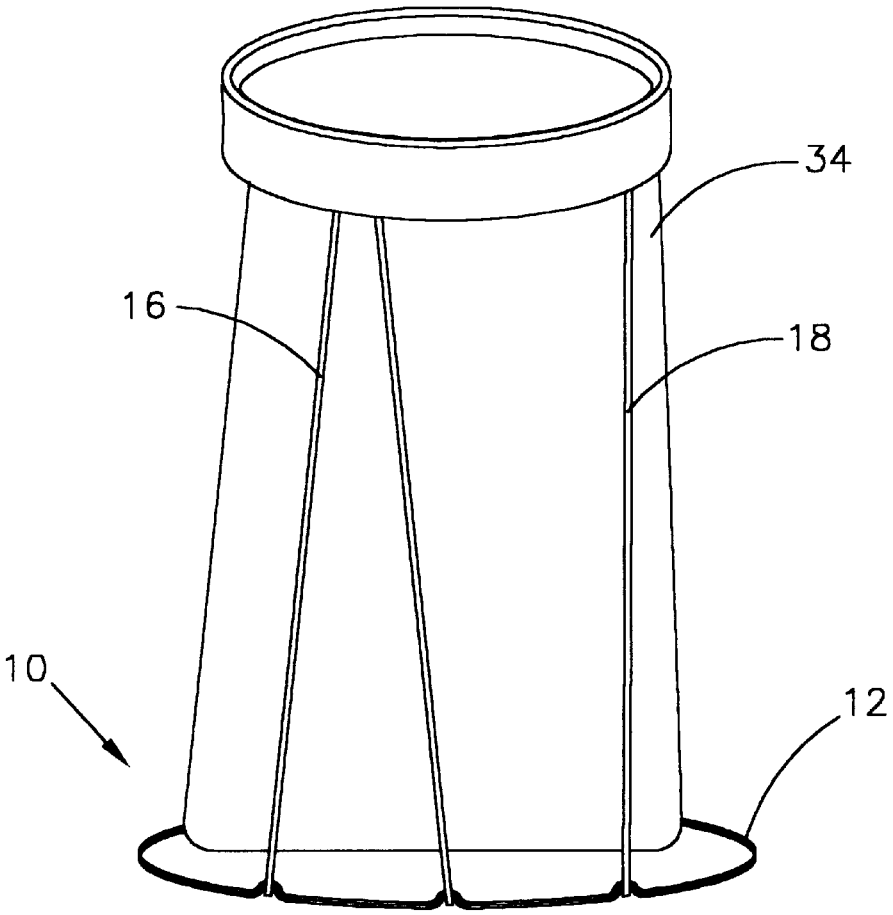
FIG. 4 is a perspective view corresponding to FIG. 1 wherein a garbage bag is shown to being supported by the garbage bag support.

With the garbage bag support 10 in its working position, a garbage bag 34 is inserted inside the hoop 14 and allowed to fill the support 10, as illustrated in FIG. 4. The bag 34 is releasably held on the garbage bag support 10 by wrapping the periphery of the open end of the garbage bag about the hoop 14, or by working a portion or portions of the open end periphery of the garbage bag 34 between the hoop 14 and the supports 16–20 so that it is held by friction. The garbage bag 34 is thus held in a vertical orientation with its open end facing upwardly for the receipt of materials to be disposed of in the bag 34. Once the supported bag 34 has been filled, the open end periphery of the bag 34 is released from the hoop 14. The filled bag 34 may then be closed in the conventional manner. The garbage bag support 10 can then be lifted over the filled bag 34 so that the possibly heavy filled bag 34 can be separated from the support 10 without requiring the lifting of the bag 34 over the top of the support 34.

Although the invention has been described with respect to a preferred embodiment thereof, it is to be also understood that it is not to be so limited since changes and modifications can be made therein which are within the full intended scope of this invention as defined by the appended claims.

We claim:

1. A support for a garbage bag, comprising:

(a) a bottom hoop;

(b) a plurality of support members attached to the bottom hoop for pivotal movement between a storage position substantially coplanar with the bottom hoop and a substantially vertical working position, the support members comprising bent upper ends;

(c) an upper hoop having a plurality of downward projecting sections, the upper loop constrained for movement with the support members between a collapsed, storage position and an elevated working position above the lower hoop supported on said support members;

(d) whereby the bent upper ends of the support members catch the downwardly projecting section of the upper hoop for releasably holding the upper hoop in the working position; and (f) wherein the support members further comprise first legs and second legs joined at the upper ends with a flat section, and wherein the first and second legs have dimples at the bent upper ends to catch the downward projecting sections of the upper hoop.

2. A garbage bag support as defined in claim 1, wherein the bottom and upper hoops are substantially circular.

3. A garbage bag support as defined in claim 1, wherein the diameter of the bottom hoop is larger than the diameter of the upper hoop.

4. A garbage bag support as defined in claim 1, wherein the bottom hoop, the upper hoop, and the support members are made of wire.

5. A garbage bag support as defined in claim 1, wherein the bottom hoop further comprises dimples and the support members further comprises lower end portions bent into eyes around the dimples of the bottom hoop.

* * * * *